United States Patent [19]

Shaw et al.

[11] 3,952,959

[45] Apr. 27, 1976

[54] TEXTILE YARN PROCESSING

[75] Inventors: Jack Shaw, Read, near Burnley; Robert Lane, Accrington, both of England

[73] Assignee: Platt International Limited, England

[22] Filed: Aug. 20, 1974

[21] Appl. No.: 498,922

[30] Foreign Application Priority Data

Aug. 23, 1973 United Kingdom ..... 40055/73

[52] U.S. Cl. ..... 242/18 PW

[51] Int. Cl.[2] ..... B65H 54/02

[58] Field of Search..... 242/18 PW, 18 A, 25 A, 242/18 DD

[56] References Cited

UNITED STATES PATENTS

| | | | |
|---|---|---|---|
| 2,481,031 | 9/1949 | McDermott | 242/18 PW |
| 3,030,039 | 4/1962 | Roberts | 242/18 PW |
| 3,275,252 | 9/1966 | Bolger | 242/18 PW |
| 3,741,488 | 6/1973 | Wuest | 242/18 PW |

*Primary Examiner*—Stanley N. Gilreath
*Attorney, Agent, or Firm*—Watson, Cole, Grindle & Watson

[57] ABSTRACT

A textile yarn processing machine for winding yarn onto a bobbin tube provided with first and second slots angularly spaced around the periphery and extending from one end of the tube, wherein a running yarn, held by a yarn collection means, is engaged in the first and second slots and the tube is placed in the winding position to initiate winding of the yarn onto the tube. A yarn guide is positioned adjacent the end of the tube having the slots therein for guiding yarn withdrawn from the collection means onto the tube as the tube is rotated in the winding direction so as to form a reserve winding.

7 Claims, 3 Drawing Figures

TEXTILE YARN PROCESSING

Figure 1:
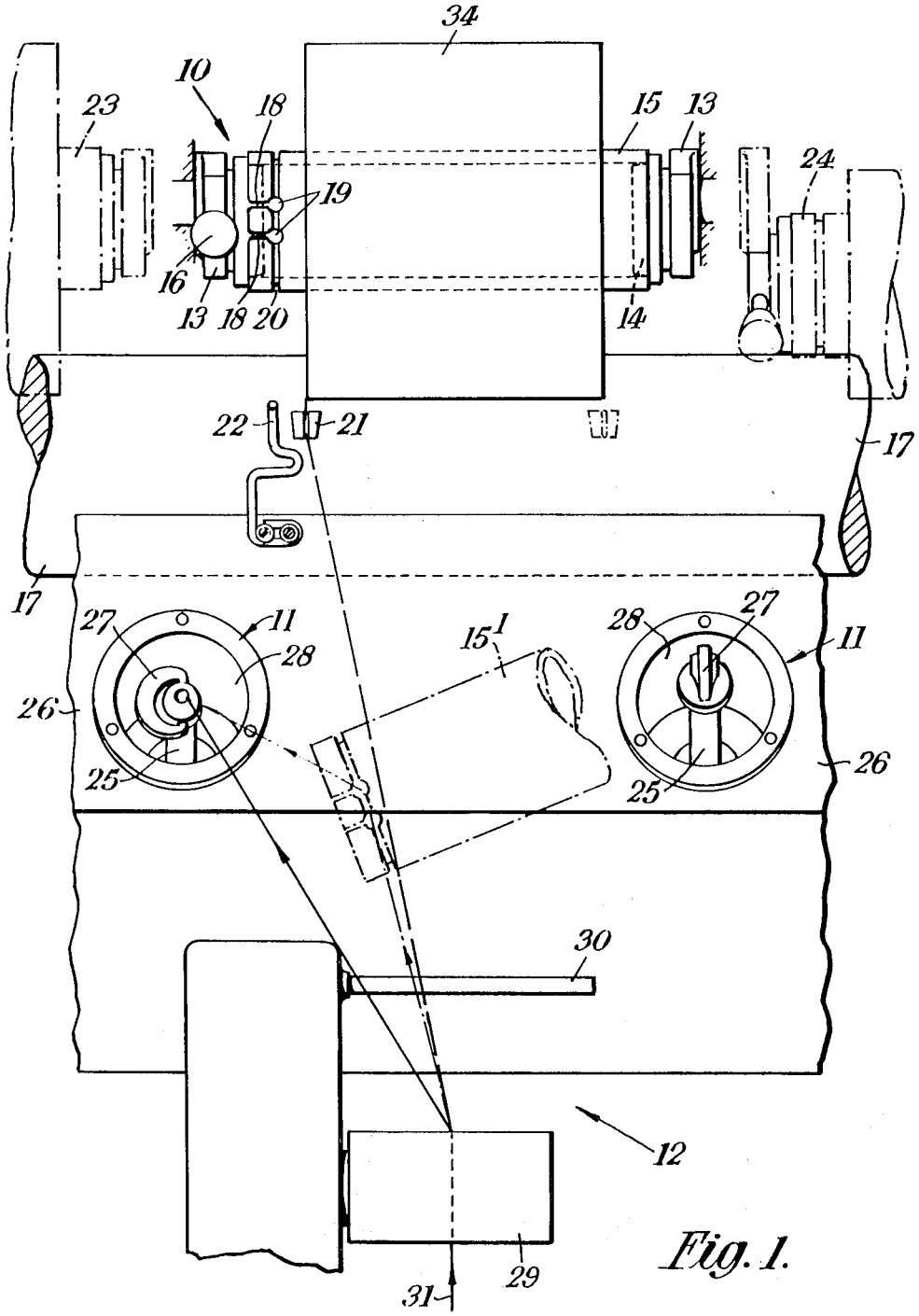

The present invention relates to textile yarn processing and more particularly to methods of and apparatus for forming a reserve winding on a bobbin in a yarn processing machine and replacing a bobbin having a completed yarn package thereon by an empty bobbin.

In many types of textile yarn processing machines it is desirable to form a reserve winding of yarn at a position outside the axial extent of the package before commencing to form the package. The reserve winding is utilized in subsequent processing for connection to an end of yarn of a further package such that on depletion of yarn from one package delivery of yarn is continued by withdrawing yarn from the other package.

According to a first aspect of the present invention, there is provided a method of winding yarn on an empty bobbin in a yarn processing machine, comprising the steps of delivering a running yarn to a yarn collection zone, engaging said running yarn with yarn engaging means formed on an empty bobbin without halting delivery of the running yarn to the yarn collection zone, and rotating said empty bobbin to wind the running yarn thereon. Preferably, the method according to the first aspect of the invention includes the step of forming a reserve winding at one end of the empty bobbin from yarn withdrawn from the yarn collection zone.

Preferably, the bobbin comprises a hollow bobbin tube and the engaging step includes passage of the running yarn through yarn engaging means which pass the yarn through the interior of the bobbin tube.

Said passage of the yarn through the yarn engaging means may include entry through a first opening of the yarn engaging means formed in the bobbin tube and exit through a second opening of the yarn engaging means formed in the bobbin tube. Said delivery step may comprise delivery to an airstream in which the yarn is entrained.

The method may further comprise the step of forming a yarn package on the bobbin.

According to a second aspect of the present invention, there is provided apparatus for carrying out the method according to the first aspect of the invention comprising yarn collecting means for collecting a running yarn delivered thereto, an empty bobbin formed with yarn engaging means and bobbin rotating means, the yarn engaging means engaging said running yarn without halting delivery of the running yarn whereby when the bobbin is rotated by the bobbin rotating means the running yarn is wound thereon.

Preferably, the yarn engaging means are arranged towards one end of the empty bobbin whereby when the bobbin is rotated by the bobbin rotating means a reserve winding of yarn is formed at said one end of the empty bobbin from yarn withdrawn from the yarn collection means. Preferably, the yarn collection means comprises a suction tube in which the yarn is entrained in an airstream.

A guide is preferably located between the yarn collection means and the rotating bobbin whereby the yarn is constrained to travel in a path in which the yarn is wound at one end of the bobbin.

The bobbin may comprise a hollow tube and the yarn engaging means may be provided by a pair of apertures, the yarn passing through the interior of the bobbin tube when the bobbin engages the running yarn. the apertures preferably comprise a pair of slots angularly spaced apart around the periphery of the bobbin tube at one end thereof, the closed end of each slot preferably being enlarged to receive the yarn when in engagement with the bobbin.

In several types of textile yarn processing machines hitherto proposed it has been found desirable to have the facility for replacing a completed yarn package by an empty bobbin without interrupting the processing. For example, in an open-end yarn spinning process, when a completed yarn package is to be replaced by an empty bobbin for subsequent winding of a yarn package thereon, it is usual to interrupt yarn delivery from the spinning rotor. When the empty bobbin is in place, a length of yarn is attached to it and the end of yarn fed back into the spinning rotor where it contacts and twists in fibres fed thereto to effect piecing-up of the yarn. Such piecing-up is, however, undesirable since the section of yarn containing the piecing may not possess the desired characteristics required of the yarn.

According to a third aspect of the present invention, there is provided a method of replacing a completed yarn package by an empty bobbin in a yarn processing machine, comprising the steps of severing the running yarn delivered to the completed yarn package, delivering the severed running yarn to a yarn collection zone, engaging said running yarn with yarn engaging means formed on an empty bobbin without halting delivery of said yarn to the yarn collection zone, removing said completed yarn package and replacing it by said empty bobbin whilst continuing the delivery of said yarn collection zone, severing said yarn at a position following its engagement with the yarn engaging means and commencing rotation of said empty bobbin to wind on yarn delivered thereto to form a yarn package thereon.

According to a fourth aspect of the invention there is provided a bobbin tube formed with at least one passage in a wall thereof, whereby when the tube is supported on bobbin supporting means and the bobbin tube to permit a running yarn which is passing through the said at least one passage before support thereof to continue to pass through the said at least one passage during support thereof.

Figure 2:
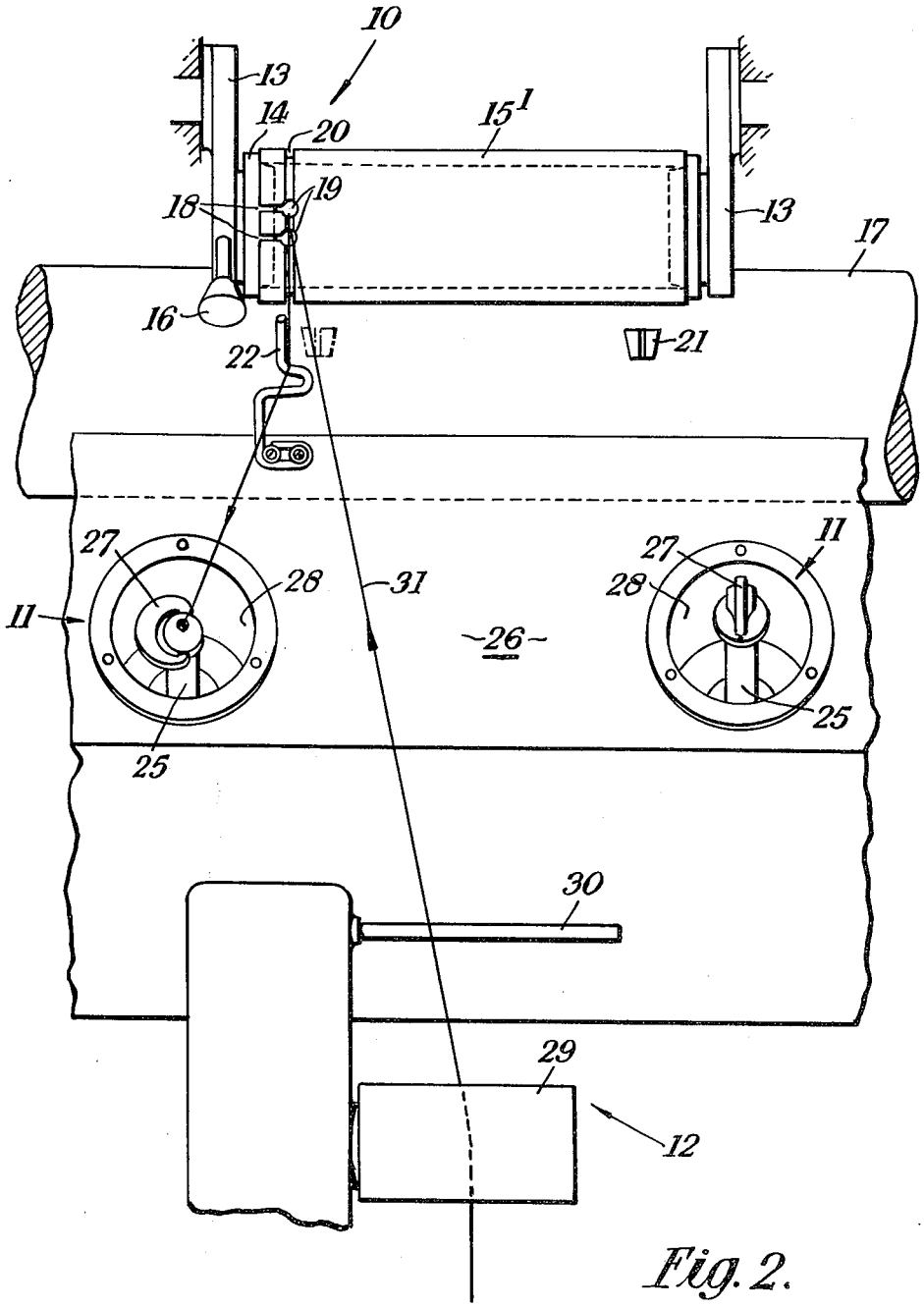
Figure 3:
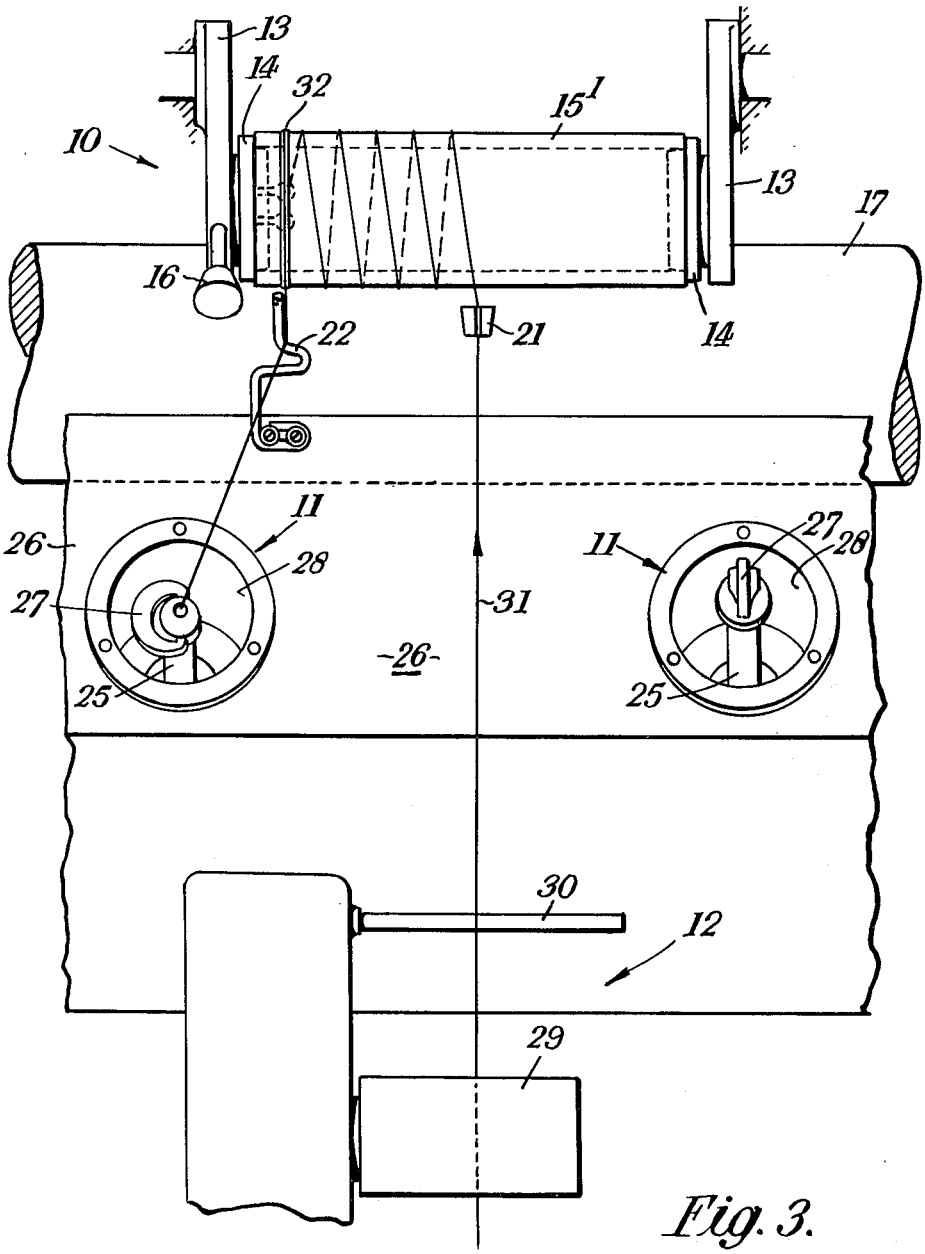

The following is a more detailed description of one embodiment of the invention, by way of example, reference being made to the accompanying drawings in which:

FIG. 1 is a front elevation of a yarn processing machine, showing a first stage in the formation of a reserve winding of yarn, FIGS. 2 and 3 are similar views of the yarn processing machine showing second and third stages respectively in the formation of a reserve winding of yarn.

Referring first to FIG. 1, the machine comprises a bobbin and bobbin rotating assembly 10, a yarn collecting assembly 11 and a yarn feed assembly 12. The bobbin and bobbin rotating assembly 10 comprise a pair of arms 13 each of which carries a rotatable flanged spigot 14 at the free end thereof. The spigots 14 extend into the open ends of a bobbin tube 15 which is thus rotatably mounted between the arms 13. A handle 16 is provided on one arm 13 to enable the bobbin tube 15 to be moved into engagement with a driving roller 17 whose axis is parallel to the axis of the bobbin tube 15.

The bobbin tube 15 comprises a hollow cylinder and is provided at one end with yarn engaging means in the form of a pair of axially extending slots 18 angularly spaced apart around the periphery of the bobbin tube 15. The slots 18 terminate in enlarged apertures 19 which are unobstructed by the spigots 14. An annular groove 20 extends around the bobbin tube 15 and diametrically intersects the enlarged apertures 19.

The assembly 10 also includes a guide 21 which is mounted on a bar (not shown) for reciprocating movement across the width of the bobbin tube 15. A yarn guide finger 22 is mounted so that it is co-planar with the groove 20.

The bobbin tube 15 is one of a plurality of such bobbin tubes 15 mounted for rotation in end-to-end relation for engagement by a common driving roller 17. Two adjacent bobbin tubes are shown in broken lines at 23 and 24.

The yarn collecting assembly 11 comprises a suction tube 25 which projects through an aperture in a facing sheet 26. The suction tube 25 is closed by a removable valve member 27 and is connected to a source of vacuum. A cylindrical wall 28 surrounds the suction tube 25 and the recess formed thereby serves as a convenient storage space for an empty bobbin tube 15 (not shown). A suction tube 25 is provided for each bobbin and bobbin rotating assembly 10.

The yarn feed assembly 12 comprises a pair of rotatable feed rollers 29 and a yarn guide bar 30.

In use, a yarn 31 produced, for example, by an open-end spinning machine (not shown) is fed by the feed rollers 29 over the yarn guide bar 30 to the bobbin tube 15 as shown in broken lines in FIG. 1. The yarn 31 is wound on the rotating bobbin tube 15 under the control of the reciprocating guide 21 to form a yarn package 34.

When the bobbin tube 15 has a full package of yarn 31 wound thereon, the valve 27 is opened and the yarn 31 is severed at a point in its path following the delivery rollers 29. The free end of running yarn 31 is fed into the suction tube 25 where it is entrained in and collected by an airstream. The handle 16 is then used to move the arms 13 so that the full bobbin tube 15 is disengaged from the driving roller 17 and can thus be removed from the arms 13.

An empty bobbin tube 15' having previously been taken from the storage space 28 is then engaged with the running yarn 31 by causing the running yarn 31 to pass into one of the enlarged apertures 19, through the interior of the bobbin tube 15' and out through the other of the enlarged apertures 19. This is shown in chain dotted lines in FIG. 1.

Referring next to FIG. 2, the bobbin tube 15' is then rotatably mounted on the arms 13 with the running yarn 31 still engaged therewith. It will be seen that the running yarn 31 then travels to the yarn collection assembly 12 from the bobbin tube 15'. The arms 13 are then lowered and when the bobbin tube 15' is almost in contact with the driving roller 17, the yarn 31 engages the yarn guide finger 22. Thus, the portion of the path between the finger 22 and the bobbin tube 15' is in a line which lies in the plane of the groove 20.

The enlarged apertures 19 ensure that, as the winding of yarn 31 commences, the yarn 31 is drawn both from the yarn 31 collected by the suction tube 25 and from the delivery rollers 29. The finger 22 ensures that the yarn 31 drawn from the suction tube 25 is wound into the groove 20. The yarn 31 from the delivery rollers 29 is engaged with the reciprocating guide 21 and is wound onto the body of the bobbin tube 15' in the usual manner as illustrated in FIG. 3.

In this way, a reserve length of yarn 32 is wound on the bobbin tube 15'. When a sufficient reserve has been accumulated, the yarn 31 is severed between the suction tube 25 and the bobbin tube 15'.

The invention permits the replacement of a completed yarn package 34 by a new empty tube 15' and the formation of a reserve winding thereon in a simple manner without the necessity of discontinuing the supply of yarn 31.

In another embodiment of the invention (not shown) a bobbin tube is provided without a groove 20. In this embodiment the reserve length of yarn 32 is wound on a portion of the bobbin surface axially beyond the normal extent of the yarn package. The yarn 31 is guided onto this portion of the bobbin tube by a yarn guide finger as described above with reference to FIGS. 1 to 3 of the drawings.

The invention permits the removal of a completed yarn package and its replacement by a new empty tube in a simple manner without the necessity of discontinuing the supply of yarn. Thus the invention is suitable for application to a yarn producing machine operating on the open-end spinning principle where, previously, it has been necessary to carry out the operation of piecing up the yarn. This has been disadvantageous in that the section of yarn containing the piecing is unsuitable for subsequent processing since it may not possess the desired characteristics of the yarn. The invention overcomes this disadvantage by eliminating the piecing-up operation on starting the formation of a new package.

I claim:

1. In a yarn processing machine having yarn collection means, a bobbin tube provided with first and second slots angularly spaced around the periphery and extending from one end thereof, support means for said bobbin tube comprising a pair of spigot members, each member being adapted for supporting the bobbin tube at a respective end, the spigot member supporting the bobbin tube at said one end projecting into the bobbin tube by a distance less than the distance that the first and second slots extend from the said one end such that when the bobbin tube is placed on the supports a first passage is provided between the first slot and the spigot member and a second passage is provided between the second slot and the spigot member, a method of winding yarn on an empty bobbin tube comprises the steps of delivering a running yarn to the yarn collection means through the first and second passages, before placing the bobbin tube on the support means passing the yarn to the inside of the bobbin tube through the first slot and exiting the yarn from the inside of the tube through the second slot, thereafter placing the bobbin tube on the spigot members while allowing the yarn to continue to run to the yarn collection means through the first and second passages and rotating the bobbin tube to wind the running yarn thereon.

2. A method according to claim 1, wherein the method further includes the step of forming a reserve winding at one end of the bobbin tube by winding yarn thereon yarn withdrawn from the yarn collection means.

3. A method according to claim 1, includes the steps of severing the running yarn delivered to the completed yarn package, delivering the severed yarn collection means, and removing the completed yarn package from the support means.

4. Apparatus for winding yarn on an empty bobbin comprising yarn feeding means for continuously feeding a running yarn, yarn collection means for collecting a running yarn fed by said yarn feeding means, a bobbin tube provided with first and second slots angularly spaced around the periphery and extending from one end thereof, support means for said bobbin tube comprising a pair of spigot members, each member adapted for supporting the bobbin tube at a respective end thereof, the spigot member supporting the bobbin tube at said one end projecting into the bobbin tube by a distance less than the distance that the first and second slots extend from the said one end to provide a first passage between the first slot and the spigot member and a second passage between the second slot and the spigot member, said first and second passages permitting a running yarn to pass from the feeding means through the first and second passages to the yarn collection means.

5. Apparatus according to claim 4, wherein the first and second slots each terminate in an enlarged aperture.

6. Apparatus according to claim 5, wherein said enlarged aperture communicates with the end of the bobbin tube by axially extending channel.

7. Apparatus according to claim 5, wherein a circumferential groove is formed in the bobbin tube at said one end so positioned as to intersect the enlarged apertures.

* * * * *